US008043069B2

(12) United States Patent
Bialick et al.

(10) Patent No.: US 8,043,069 B2
(45) Date of Patent: Oct. 25, 2011

(54) WATER REMOVAL FROM A SUMP USING PUMP AND SWITCHING MECHANISM

(75) Inventors: Richard Bialick, Maple Grove, MN (US); Britt Aaseby, Maple Grove, MN (US); George Anderson, Maple Grove, MN (US); David Dubbe, Maple Grove, MN (US)

(73) Assignee: H2O Gone, LLC, Plymouth, MN (US)

( * ) Notice: Subject to any disclaimer, the term of this patent is extended or adjusted under 35 U.S.C. 154(b) by 291 days.

(21) Appl. No.: 12/269,582

(22) Filed: Nov. 12, 2008

(65) Prior Publication Data

US 2009/0123296 A1 May 14, 2009

Related U.S. Application Data

(60) Provisional application No. 60/987,851, filed on Nov. 14, 2007.

(51) Int. Cl.
*F04B 49/00* (2006.01)
*B66B 20/00* (2006.01)

(52) U.S. Cl. ..... 417/38; 187/414

(58) Field of Classification Search ..... 417/36, 417/38; 210/97, 165, 170.04, 170.07; 73/732, 73/741, 756; 137/363, 565.37, 565.17, 590, 137/557; 187/414

See application file for complete search history.

(56) References Cited

U.S. PATENT DOCUMENTS

| | | | | |
|---|---|---|---|---|
| 3,136,871 | A * | 6/1964 | Barletta | 200/81 R |
| 3,397,716 | A * | 8/1968 | Andersson | 417/38 |
| 3,424,883 | A * | 1/1969 | Heskett | 200/81.9 R |
| 3,454,043 | A * | 7/1969 | Harper | 417/36 |
| 3,550,778 | A * | 12/1970 | Gussie | 210/167.3 |
| 3,656,866 | A * | 4/1972 | Hine et al. | 417/38 |
| 3,775,026 | A * | 11/1973 | Hewlings | 417/36 |
| 3,992,130 | A * | 11/1976 | Childress | 417/36 |
| 4,295,793 | A * | 10/1981 | McGalliard | 417/36 |
| 4,652,368 | A * | 3/1987 | Ennis et al. | 210/97 |
| 5,923,102 | A * | 7/1999 | Koenig et al. | 307/118 |
| 7,755,318 | B1 * | 7/2010 | Panosh | 318/778 |

OTHER PUBLICATIONS

Los Angeles Department of Building and Safety (LADBS), Information Bulletin/Public Plumbing Code, Document P/PC 2002-004, "Elevator Pit Drains."*

* cited by examiner

*Primary Examiner* — Devon C Kramer
*Assistant Examiner* — Nathan Zollinger
(74) *Attorney, Agent, or Firm* — Leffert Jay & Polglaze P.A.

(57) ABSTRACT

A water removal system for removing water from an elevator pit that includes a sump, a pump, a pump input tube, a pump output tube and a switching mechanism. The sump at least partially extends below a lower surface of the elevator pit. The plump mounted outside of the elevator pit. The pump input line is operably connected to the sump and the pump. The pump output line is operably connected to the pump. The switching mechanism is mounted outside of the sump and is operably connected to the pump and the sump.

13 Claims, 2 Drawing Sheets

WATER REMOVAL FROM A SUMP USING PUMP AND SWITCHING MECHANISM

REFERENCE TO RELATED APPLICATION

This application claims priority to U.S. Provisional Applic. No. 60/987,851, filed Nov. 14, 2007, the contents of which are incorporated herein by reference.

FIELD OF THE INVENTION

The invention relates generally to a water removal system. More particularly, the invention relates to an elevator pit water removal system.

BACKGROUND OF THE INVENTION

Elevators have gained significant popularity in modern society as the elevators enable persons even with limited physical capabilities to move between the floors in buildings. As elevators enable buildings to be much taller, society has been able to form into more densely populated business and residential configurations.

Since it is often desirable for the elevators to service all of the floors in a particular building, it is necessary for a pit to be formed beneath the elevator that is adapted to receive a lower portion of the elevator that is below the floor of the lowest level.

Depending on the area in which the building is located, water may be present in the ground that is located beneath the building. Because of the position of the elevator pit beneath the ground level, the presence of water surrounding the elevator pit may cause water to leak into the elevator pit. If such water is not removed from the elevator pit, the water may cause degradation of the elevator components that are located in the elevator pit and thereby impact the safe operation of the elevator.

The ground water may exert hydronic pressure on the components of the building and, if not released, may cause damage to the components of the building. Such damage may ultimately render the building uninhabitable.

One technique for removing water from an elevator pit involves placing a pump in the elevator pit. While this option enables water to be removed from the elevator pit, the building/elevator codes in many parts of the country do not permit mechanical devices other than elevator related equipment to be placed in the elevator pit.

One technique that has been utilized to prevent water from entering the elevator shaft is applying a waterproof coating to the walls and floor of the elevator shaft. While this technique may restrict water from entering the elevator shaft, this technique often fails due to hydronic pressure caused by water in the ground surrounding the elevator pit.

Because of the building components that surround the elevator pit, it is often not possible to excavate the area surrounding the elevator pit to install other water removal systems. Additionally, worker protection regulations also would necessitate the length and width of such a hole to be impermissibly large.

SUMMARY OF THE INVENTION

An embodiment of the invention is direct to a system for removing water from an elevator pit. The water removal system may include a sump basket, a pump assembly and a water level sensor. The sump basket may be located in or under the elevator pit. The pump assembly removes water from the sump basket. The water level sensor controls the operation of the pump assembly based upon the level of water in the sump.

DETAILED DESCRIPTION OF THE PREFERRED EMBODIMENTS

Figure 1:
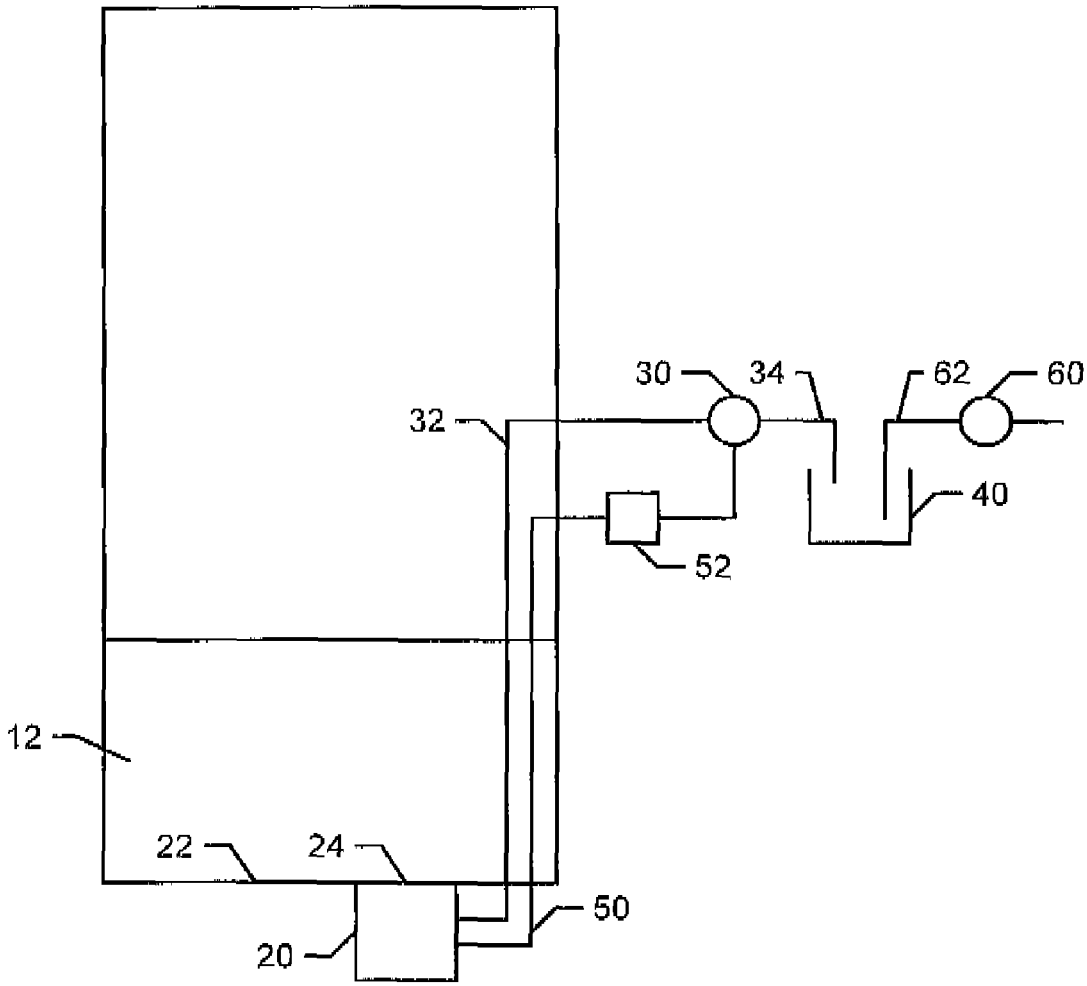
FIG. 1 is a schematic illustration of a water removal system according to an embodiment of the invention.

An embodiment of the invention is directed to a water removal system, as illustrated at 10 in the Figures. While the water removal system is particularly suited for use in conjunction with an elevator pit 12, the water removal system 10 may be adapted for other applications in which water must be removed.

The water removal system 10 includes a sump basket 20 that is installed in a lower surface 22 of the elevator pit 12. The sump basket 20 is fabricated with a size that is adapted to receive the water that flows into the sump basket 20 without overflowing. The larger the width and depth of the sump basket 20, the more water that can accumulate in the sump basket 20.

In one configuration, the sump basket 20 has a cylindrical shape with a width and a height that are each between about 12 and 36 inches. In another configuration, the width and the height of the sump basket 20 are each between about 20 and 30 inches.

The sump basket 20 may be fabricated from a variety of materials such as plastic or concrete. Additionally, the sump basket 20 may be pre-fabricated or formed on site. To increase the safety of the elevator pit 12 and prevent objects from inadvertently entering the sump basket 20, a sump lid 24 may be placed over the sump basket 20.

While the sump lid 24 substantially covers the sump basket 20, the sump lid 24 may permit water on the lower surface 22 of the elevator pit 12 to drain into the sump basket 20. Drain tile from walls and/or floors may be tied into the sump basket 20.

The water removal system 10 also includes a pump assembly 30 that is located outside of but in proximity to the elevator pit 12. The size and capacity of the pump assembly 30 may be selected based upon a variety of factors such as a height the water must be lifted for discharge, the run over which the water must be pumped to reach the discharge and the volume of water that must be removed from the sump basket 20. In one configuration, the pump assembly is a shallow well style pump.

The pump assembly 30 is operably connected to the sump basket 20 with a pump inlet tube 32. The size and material from which the pump inlet tube 32 is fabricated are selected based upon the volume of water that must be removed from the stump basket 20. In one configuration, the pump inlet tube 32 has a diameter of about one inch and is fabricated from copper.

Depending on the size of the elevator pit 12, the pump inlet tube 32 may be mounted on the surface of the wall or floor of the elevator pit 12. Alternatively, the p-ump inlet tube 32 may be mounted behind the wall or floor of the elevator pit 12.

A pump outlet tube 34 is attached to the pump assembly. Water pumped out of the sump basket 20 using the pump assembly 30 may be directly discharged. Alternatively, depending on the composition of the water pumped out of the sump basket 20, the water may need to be treated prior to discharge.

In certain embodiments, if the water contains contaminants such as oil that exceed applicable building or environmental codes, a separator sump 40 may be utilized to collect the water from the pump outlet tube 34 and then separate the contaminants from the water such as through settling.

In such a configuration, a separator pump 60 may be utilized to discharge water from the separator sump 40 using a separator sump outlet tube 62. The separator pump 60 may have a variety of configurations such as being at least partially submersed in the separator sump 40. Alternatively, it is possible for the water removal system 10 to utilize a trap to prevent the escape of sewer gas.

In many applications, it will not be necessary or desirable for the pump assembly 30 to run continuously. Operation of the pump assembly 30 may be controlled by a water level sensor that monitors the water level in the sump basket 20.

In one configuration, the water level sensor utilizes a pressure sensor tube 50 that extends from the sump 40 to a pressure switch 52. As the level of water in the sump basket 20 exceeds a specified level, the water pressure inside the end of the pressure sensor tube 50 inside the sump basket 20 raises and such pressure increase is transmitted to the pressure switch 52, which controls the operation of the pump assembly 30.

The size and material from which the pressure sensor tube 50 is fabricated are selected based upon the pressure sensitivity and the length of the pressure sensor tube 50. In one configuration, the pressure sensor tube 50 has a diameter of about one half of an inch and is fabricated from copper.

Depending on the size of the elevator pit 12, the pressure sensor tube 50 may be mounted on the surface of the wall or floor of the elevator pit 12. Alternatively, the pressure sensor tube 50 may be mounted behind the wall or floor of the elevator pit 12.

Because of the location of the pump inlet tube 32 and the pressure sensor tube 50 in the elevator pit 12, it may be difficult to inspect these tubes. It may also be difficult to access the components of the water removal system 10 to ensure that they are operating correctly. To enable the evaluation operation of the water removal system 10, the pump inlet tube 32 and/or the pressure sensor tube 50 may have a valve that may be used for introducing water into the sump basket 20 for testing the operation of the water removal system 10.

Figure 2:
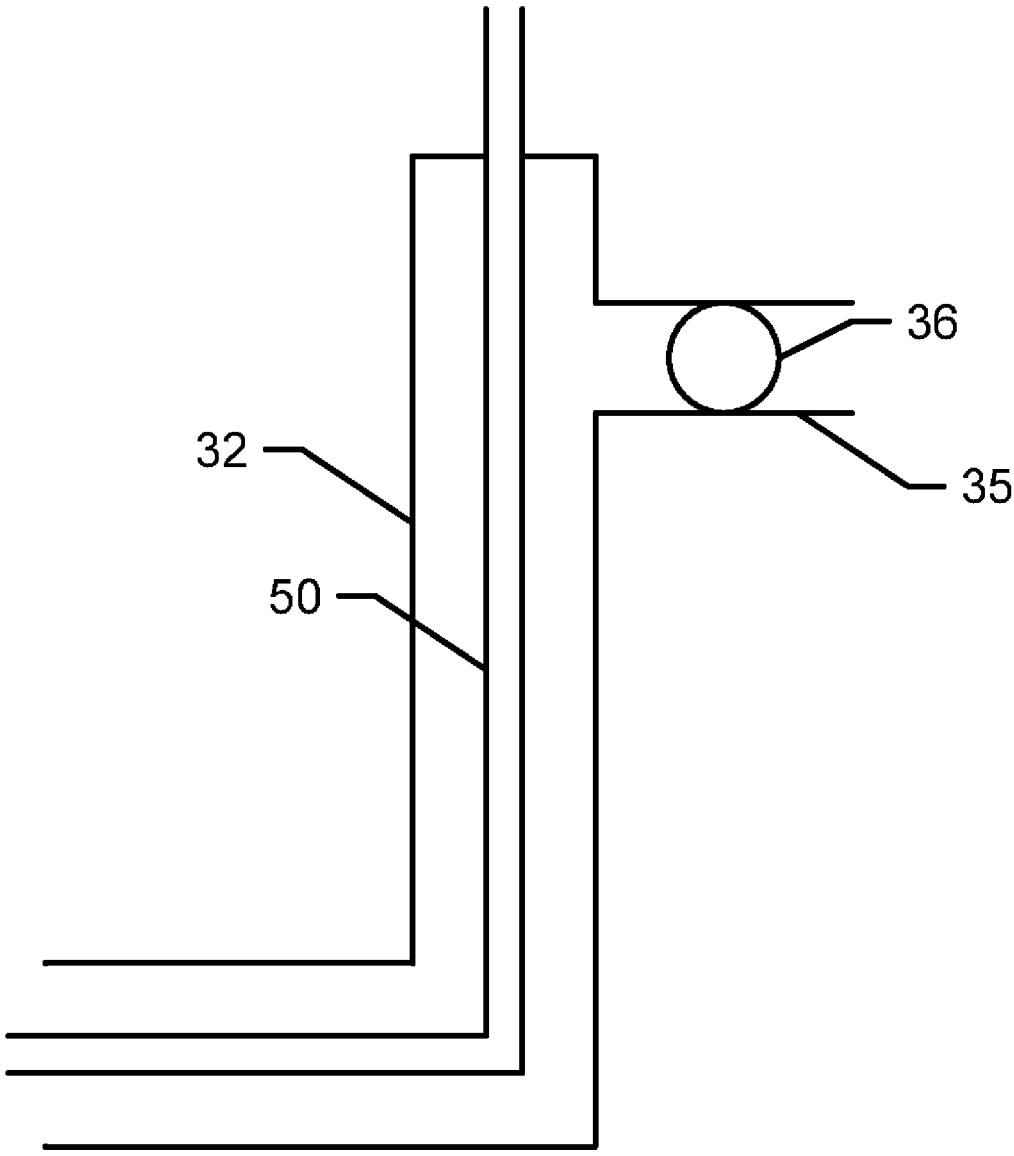
FIG. 2 is a side view of an alternative configuration of the pump inlet tube and the pressure sensor tube.

As an alternative to separately mounting the pump inlet tube 32 and the pressure sensor tube 50 in the elevator pit 12, it is possible to mount one of the tubes inside of the other tube for a portion of the length, as illustrated in FIG. 2. In one configuration, the pressure sensor tube 50 may be mounted inside of the pump inlet tube 32, as the pressure sensor tube 50 is generally smaller than the pump inlet tube 32.

As an alternative to configuring the water level sensor to operate using a hydraulic mechanism, it is possible to operate the water level sensor using other mechanisms. Examples of such alternative mechanisms for the water level sensor include pneumatic and optical. The pneumatic system could operate using a mechanism that is similar to the mechanism discussed above with respect to the hydraulic system.

An optical system could include a light source and a light sensor. The light source may be mounted outside of the elevator pit 12 to comply with building codes. The light can be directed from the light source to the light sensor using optical fibers. The presence of water interrupts the path of light between the light source and the light sensor such that it can be determined when the water level has reached a point where the pump 30 should be activated.

The water level sensor may include a high water alarm and a low water alarm such that the pump 30 is activated when the water level is higher than the high water alarm and deactivated when the water level is lower than the low water alarm. Alternatively, the pump 30 can be activated when the water level is higher than the high water alarm and then deactivated after a selected period of time.

The water level sensor thereby enables the water to be removed from the sump basket 20 without the use of mechanical devices placed inside of the sump basket 20. The water removal system 10 thereby protects the components of the elevator that are located within the elevator pit 12 while complying with the applicable building codes.

In another configuration, the water level sensor utilizes a float (not shown) mounted in the sump basket 20. Once the float rises above a specified level, the pump assembly 30 is activated.

In conjunction with the water removal system 10, additional components may be utilized to protect the components of the elevator from damage caused by water accumulating in the elevator pit 12. Such additional components include applying a waterproof sealant to the walls and floor of the elevator pit 12. Another additional component is a drain tile system placed along the intersection of the walls and floor of the elevator pit 12. One such drain tile system is available under the trademark BEAVER.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A water removal system for removing water from an elevator pit, wherein the water removal system comprises:

a sump basket that at least partially extends directly below a lower surface of the elevator pit;

a pump mounted outside of the elevator pit;

a pump input tube that is operably connected to the sump basket and the pump;

a pump output tube that is operably connected to the pump; and a switching mechanism mounted outside of the sump basket, wherein the switching mechanism is operably connected to the pump and the sump basket, the switching mechanism including a pressure sensor tube mounted concentrically within the pump input tube.

2. The water removal system of claim 1, wherein the switching mechanism is pneumatically, hydraulically or optically operated.

3. The water removal system of claim 1, wherein the switching mechanism includes a sump water sensor.

4. The water removal system of claim 1, wherein the pump input tube is mounted to a surface of the elevator pit.

5. The water removal system of claim 1, and further comprising a separator sump operably connected to the pump output tube.

6. The water removal system of claim 5, and further comprising a separator sump pump to remove water from the separator sump.

7. A method of removing water from an elevator pit, wherein the method comprises:

providing a sump basket that at least partially extends directly below a lower surface of the elevator pit;

pumping water from the sump basket with a pump; and controlling the operation of the pump using a switching mechanism, wherein the pump and the switching mechanism are located outside of the elevator pit and wherein the switching mechanism activates when a level of water in the sump basket exceeds a high sump water sensor, including providing a pressure activatable switch and extending a pressure sensor tube between the pressure activatable switch and the sump basket, wherein the pressure sensor tube is mounted concentrically within a pump input tube.

8. The method of claim 7, wherein the switching mechanism is pneumatically, hydraulically or optically operated.

9. The method of claim 7, wherein the switching mechanism further comprises a low sump water sensor and wherein the switching mechanism causes the pump to deactivate when the water level falls below the low sump water sensor.

10. The method of claim 7, and further comprising collecting water from the pump in a separator sump.

11. The method of claim 10, and further comprising pumping water from the separator sump with a separator sump pump.

12. The system of claim 1, wherein the pump input tube has a valve for introduction of fluid to the sump basket.

13. The system of claim 1, wherein the switching mechanism operates by providing a pressure activatable switch, and extending the pressure sensor tube between the pressure activatable switch and the sump basket.

* * * * *